US007607795B2

(12) United States Patent
Engel

(10) Patent No.: US 7,607,795 B2
(45) Date of Patent: Oct. 27, 2009

(54) LOCKING MECHANISM FOR LIGHT FITTINGS

(75) Inventor: Hartmut S. Engel, Monrepos Strasse 7, Ludwigsburg (DE) 71634

(73) Assignee: Hartmut S. Engel, Ludwigsburg (DE)

( * ) Notice: Subject to any disclaimer, the term of this patent is extended or adjusted under 35 U.S.C. 154(b) by 230 days.

(21) Appl. No.: 11/576,796

(22) PCT Filed: Sep. 30, 2005

(86) PCT No.: PCT/EP2005/010600

§ 371 (c)(1),
(2), (4) Date: Apr. 5, 2007

(87) PCT Pub. No.: WO2006/037572

PCT Pub. Date: Apr. 13, 2006

(65) Prior Publication Data

US 2008/0186719 A1 Aug. 7, 2008

(30) Foreign Application Priority Data

Oct. 5, 2004 (DE) ..... 10 2004 048 484

(51) Int. Cl.
*F21S 8/02* (2006.01)
*F21V 21/02* (2006.01)

(52) U.S. Cl. ..... 362/147; 362/364

(58) Field of Classification Search ..... 362/147, 362/364, 368, 370, 404
See application file for complete search history.

(56) References Cited

U.S. PATENT DOCUMENTS 3,248,535 A * 4/1966 Feig et al. ..... 362/364
5,012,395 A * 4/1991 Wettengel et al. ..... 362/222
5,597,234 A * 1/1997 Winkelhake ..... 362/364
6,000,818 A * 12/1999 Caluori ..... 362/365
6,164,802 A * 12/2000 Gromotka ..... 362/375
6,371,621 B1 4/2002 Le Bel
6,431,723 B1 * 8/2002 Schubert et al. ..... 362/147
7,118,254 B2 * 10/2006 Czech ..... 362/365

FOREIGN PATENT DOCUMENTS

DE 3730322 A1 3/1989
DE 19505471 A1 8/1996
DE 10360948 A1 12/2003
DE 202004000052 U1 1/2004

* cited by examiner

*Primary Examiner*—Stephen F. Husar
*Assistant Examiner*—Peggy A. Neils
(74) *Attorney, Agent, or Firm*—Gifford, Krass, Sprinkle, Anderson & Citkowski, P.C.

(57) ABSTRACT

A light fitting, particularly a built-in light fitting for ceilings and/or walls, includes an embeddable housing for receiving lighting means, a reflector, a housing frame, a functional frame, which can be detached at least partially from the housing frame and a locking device, which acts between the housing frame and functional frame. The locking device includes at least one wire spring, the wire spring being provided with a spring section extending between two locking elements formed in end areas of the wire spring. The locking elements cooperate with a respective locking receiving element in the functional frame. A wire limb is respectively formed between the spring section and locking elements. When the wire limb is pivoted and the spring section is deformed as a result, it is possible to modify the relative position of the locking elements relative to each other.

15 Claims, 5 Drawing Sheets

LOCKING MECHANISM FOR LIGHT FITTINGS

CROSS-REFERENCE TO RELATED APPLICATIONS

This application is a National Stage of International Application No. PCT/EP2005/010600, filed Sep. 30, 2005, and which claims the benefit of German Patent Application No. 10 2004 048 484.8, filed Oct. 5, 2004. The disclosures of the above applications are incorporated herein by reference.

FIELD OF THE INVENTION

The invention relates to a lamp, in particular a built-in lamp for ceilings and/or walls, comprising an installation housing designed for the reception of a light source, a reflector and associated mechanical and electrical and/or electronic components, a housing frame connected to the housing and a functional frame releasable from the housing frame at least regionally as well as a closing arrangement effective between the housing frame and the functional frame.

BACKGROUND

The statements in this section merely provide background information related to the present disclosure and may not constitute prior art.

It is known with built-in lamps whose reflector is closed by a cover plate in the direction of illumination to fasten the cover frame holding the cover plate to the housing via a screw connection, a bayonet connection or a snap/latch connection in order to be able to carry out the changing of the light source or a cleaning procedure after releasing the corresponding connection.

SUMMARY

It is the object of the present invention to configure the closing arrangement between the housing frame and the functional frame in a cost-effective manner in a built-in lamp of the initially named kind such that a change of light source can be carried out comfortably and without the use of tools, with it in particular being made possible also to use the closing arrangement with lamps in which the longitudinal extent of the light source coincides with the main direction of illumination. With lamps of the last-named type, it must be taken into account that, when the light source extends through and into a rear reflector opening and the reflector is coupled to the functional frame, the latter can only be pulled off in a linear fashion in the main direction of illumination and cannot, for instance, be pivoted with respect to the housing.

In accordance with the invention, this object is satisfied in that the closing arrangement has at least one wire spring, in that the wire spring has a spring portion which extends between two latch elements formed in the end regions of the wire spring, in that the latch elements cooperate in each case with a latch receiver in the functional frame, in that a respective wire limb is formed between the spring portion and the latch elements so that the relative position of the latch elements with respect to one another can be changed by a pivoting of the wire limbs and a deforming of the spring portion associated therewith.

The closing arrangement in accordance with the invention can thus be manufactured in an extremely cost-effective manner since it substantially only comprises one or two wire springs to be bent in the required manner in each case and latch receivers associated with them, with the latch receivers, for example, being able to be manufactured together with the functional frame by means of a single plastic injection molding procedure. If, in accordance with a preferred embodiment of the invention, the functional frame is furthermore not pivotably supported at the housing frame, but is only connected thereto via the wire springs in accordance with the invention, it is furthermore possible to pull the functional frame from the housing frame in a linear fashion in the main direction of illumination so that the use of light sources extending in the main direction of illumination is possible without problem.

The housing frame is preferably received in a shape matched manner in the housing or is fixedly connected to it, in particular made in one piece with the housing, with the wire spring being arranged with its two wire limbs supporting the latch elements in two cut-outs at the outer side of the housing frame. In this manner, the closing arrangement in accordance with the invention can be integrated into the total structure of the lamp in a practically hidden manner, whereby every irritating formation of shadows is effectively avoided. If a plurality of wire springs are provided, two cut-outs of this type are provided in each case per wire spring.

The wire limbs can be arranged on the outer side of the housing frame and the spring portion can be arranged on the inner side of the housing frame, with the latch elements extending inwardly through guide slots provided in the housing frame so that the wire spring is held at the housing frame in that it surrounds the housing frame along a plurality of sides and additionally extends through the guide slots into the housing frame. The provision of separate fastening means for the fixing of the wire spring at the housing frame can be saved in this manner. Since the wire spring is made as elastic, it can be clipped into the cut-outs and guide slots provided at the housing frame in a simple manner, whereupon the wire spring is connected in an unclosable manner to the housing frame and is precisely positioned in the desired manner.

The wire limbs are preferably pivotable in the cut-outs provided at the housing frame in dependence on the movement of the latch elements. It is thus ensured that the wire limbs are located fully inside the cut-outs in every position they adopt on the establishing or releasing of the connection between the functional frame and the housing frame.

It is particularly advantageous if the wire spring engages over the housing frame with two connection regions disposed in each case between the spring portion and the wire limbs and if the spring portion disposed at the inner side of the frame is disposed in the introductory path of the functional frame and acts on it in a resilient manner in the direction of opening. A pressure is exerted on the functional frame in its open direction by this resilient action both on the establishing and on the releasing of the connection between the functional frame and the housing frame. On the establishing of the connection, a fitter must directly overcome this pressure, whereby he is in particular also signaled by a feelable and audible latching of the latch elements that he is carrying out the assembly correctly, whereas the exertion of pressure on the releasing of the connection has the effect that the functional frame is moved away from the housing frame in the desired manner in the opening direction.

In accordance with the invention, a "push-push" closing arrangement is thus in particular provided for rectangular or square downlights, wherein the specifically designed wire spring has a dual function at least in that it cooperates with the latch cut-outs for the fixing of the functional frame, on the one hand, and exerts a pre-tensioning force on the functional frame, on the other hand, which is necessary or desirable as the counter force for the operating procedure and moves the functional frame into an opening position in a compulsory manner on the opening.

Alternatively to the above embodiment, wherein the wire spring has the said dual function, the resilient action on the functional frame can also be achieved by other elements than the wire spring. It is, for example, possible to arrange a respective separate spring element, in particular a respective spiral spring, in the corner regions of the housing frame and of the functional frame, said spiral spring being connected either to the housing frame or to the functional frame. These spring elements are disposed in the introductory path of the functional frame and act on it resiliently in the opening direction. The spring elements are preferably inserted in bores which are formed in the corner regions of the housing frame and are open in the direction of the functional frame.

It is of advantage in this alternative embodiment that a canting of the functional frame on the fastening to the housing frame or on the release from the housing frame is particularly effectively avoided.

The last named variants in accordance with the invention can be realized cost-effectively with high functional reliability, for example in that the latch elements are formed by a respective angled end region of the wire spring extending through the guide slots in the housing frame and in that the respective latch receiver belonging to a latch element has a move-in track and a move-out track as well as a latch position provided therebetween, with the latching and unlatching of the latch elements taking place by exertion of pressure onto the functional frame in its closing direction. The use of the principle in accordance with the invention is particularly sensible in lamps of the already initially named type which only permit a linear pulling off of the functional frame in the main direction of illumination since a pivoting of the functional frame is not possible as a result of the light source extending through the reflector or would only be possible if the loss of large reflector surfaces were accepted as a result of a correspondingly large rear reflector opening. In the last-named lamp types, for example, two wire springs can be provided at mutually oppositely disposed sides of the housing frame, which is in particular rectangular or square, so that ultimately a latch element is located in each corner region of the housing frame.

A peripheral seal, in particular labyrinth seal, is preferably formed in the introduced and latched position of the functional frame between it and the housing frame to achieve a dust-free closing.

The functional frame can be made in the already explained manner as a support of a reflector or at least of a part reflector. It can furthermore, additionally or alternatively to a light impermeable cover plate, also support a diffuser plate through which diffuse light can exit from the lamp.

It is furthermore advantageous for the functional frame to be coupled to at least one flexible holding element which continues to connect the functional frame to the housing frame in its position released from the housing frame. It is thus prevented that a fitter has to handle a separate component, that is the functional frame with the elements located therein, on the changing of a light source or on the carrying out of a cleaning procedure. The functional frame can rather be let go of by the fitter after a release from the housing frame since it continues to hang at the housing frame via the flexible holding element. To end the installation process, the functional frame hanging at the housing can simply be gripped again and connected to the housing frame.

Two flexible holding elements are preferably attached to a side of the functional frame so that it cannot rotate around a vertical axis with respect to the housing frame. The installation process following a change of light source, for example, is thereby facilitated since the frame already hangs in a largely correct position at the housing frame and can accordingly not be orientated incorrectly relative to the housing by the fitter on the installation.

It is particularly economic if the holding elements are shaped in one piece with the functional frame, with the functional frame in particular being able to be made as a plastic injection molded part. In this case, the functional frame and the holding elements can then be manufactured in a simple manner by means of a single injection molding process.

So that the holding elements are no longer visible with an installed functional frame, they can be pushable into the lamp housing or the housing frame with their region remote from the functional frame during the assembly. On the disassembly, in contrast, the holding elements are pulled out of the housing or out of the housing frame, with them, however, being fixed in their end position in the housing or in the housing frame so that they cannot be fully moved out of the housing or housing frame.

Further preferred embodiments of the invention are described in the dependent claims.

DRAWINGS

The drawings described herein are for illustration purposes only and are not intended to limit the scope of the present disclosure in any way.

FIG. 1 is a three-dimensional view of a functional frame in accordance with the invention with two wire springs;

FIGS. 2*a* to 2*d* are schematic side views of a functional frame in accordance with FIG. 1 with different positions of a wire spring on the introduction into and the moving out of latch receivers in accordance with the invention;

FIG. 3*a* is a three-dimensional view of a lamp housing in accordance with the invention with a housing frame to which a functional frame in accordance with FIG. 1 is fastened;

FIG. 3*b* is a view in accordance with FIG. 3*a* in which the lamp housing is shown as transparent;

DETAILED DESCRIPTION

Figure 1:
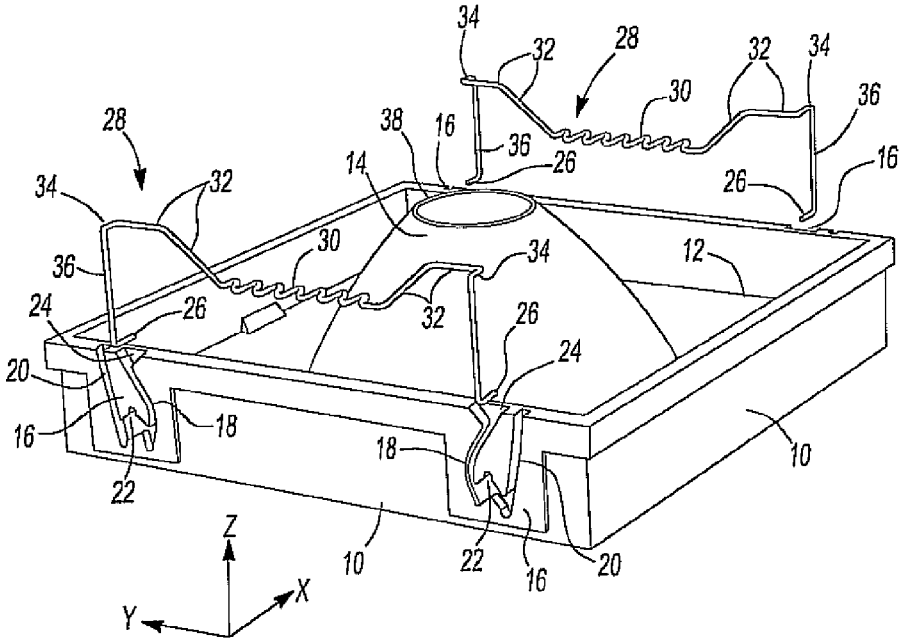

The following description is merely exemplary in nature and is not intended to limit the present disclosure, application, or uses. It should be understood that throughout the drawings, corresponding reference numerals indicate like or corresponding parts and features.

FIG. 1 shows a substantially square functional frame 10 in which a cover plate 12 as well as a reflector 14 are held in a suitable manner. The functional frame 10 has a peripheral side wall which extends perpendicular to the cover plate 12. In two mutually oppositely disposed side walls, two respective latch receivers 16 are formed which are located in the end regions of the respective side walls so that ultimately one latch receiver 16 is present in each corner region of the functional frame 10. In an alternative embodiment of the invention, two respective latch receivers 16 could also be formed at all four sides of the functional frame 10.

Each latch receiver 16 has a move-in track 18 as well as a move-out track 20 between which a latch position 22 is formed. The move-in track 18 has a funnel-like expanded portion 24 in its upper region via which latch elements 26 of a wire spring 28 can be inserted into the move-in track 18 in the relaxed state of the wire spring 28, initially without deformation of the same.

The embodiment of the wire spring 28 will be explained in the following with reference to the coordinate system drawn in FIG. 1. The axes x and y of this coordinate system span that plane in which the cover plate 12 extends. The axis z extends perpendicular to this plane.

The wire spring 28 has a central spring portion 30 which extends in the direction of the axis y and is bent in the manner of a coil in order thus to amplify the spring effect. The spring portion 30 is adjoined at both sides by two wire portions 32 which extend in a straight direction obliquely upwardly within the plane spanned by the axes y and z and which are angled in their end region remote from the spring portion 30 such that they extend parallel to the axis y.

Connection regions 34 respectively adjoin the ends of the wire portions 32 remote from the spring portion 30 and extend parallel to the axis x, outwardly seen from the reflector 14.

A wire limb 36 in each case in turn adjoins the connection regions 34 and extends downwardly parallel to the axis z starting from the respective connection region 34 and in each case supports a latch element 26 at its lower end. The latch element 26 extends parallel to the axis inwardly toward the reflector 14.

The total wire spring 28 with spring portion 30, wire portions 32, connection regions 34, wire limbs 36 and latch elements 26 is produced from a single wire piece which is bent in each case in the desired manner and has elastic properties so that it in particular returns to its original shape again after a deformation of the spring portion 30 taking place in moderation.

The cooperation between the two wire springs 28 and the four latch receivers 16 described in the following in connection with FIGS. 2*a* to *d* makes it possible that the functional frame 10 can be released from or coupled to a lamp housing, not shown in FIG. 1, parallel to the direction z so that a light source extending along the direction z can be moved into and out of a rear reflector opening 38, without the reflector 14 and the light source colliding with one another.

Figure 2A:
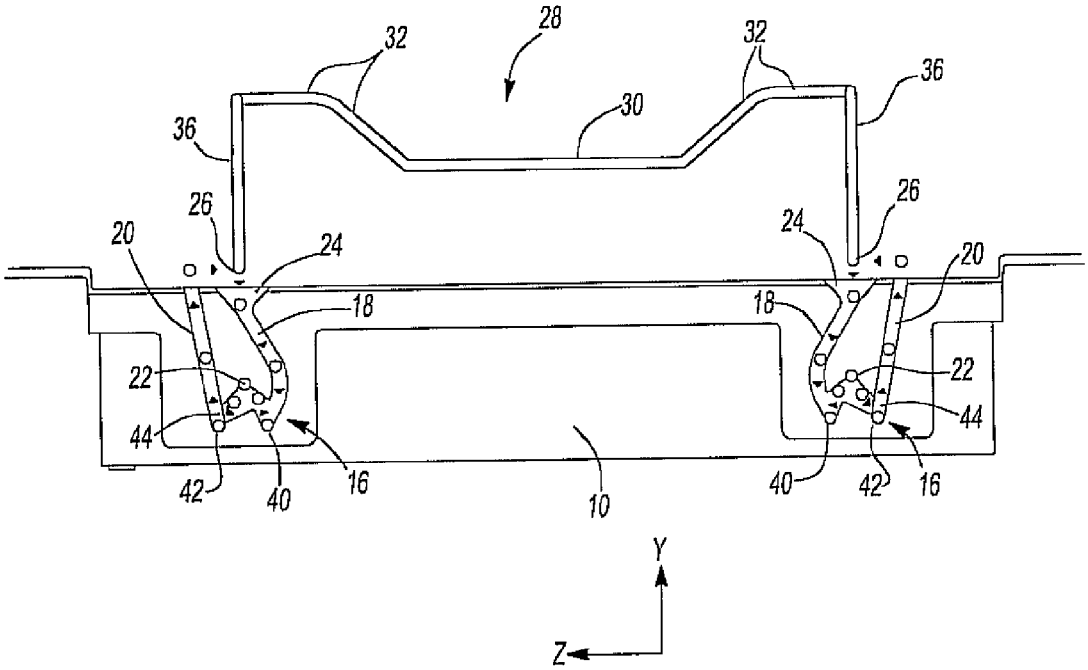

FIGS. 2*a* to *d* illustrate that the latch receivers 16 each have an arcuate inwardly arched move-in track 18 beneath the funnel-like expanded portion 24, said move-in track continuing obliquely upwardly outwardly in a hook form after reaching a lower end point 40 until a latch position 22 disposed approximately beneath the expanded portion 24 is reached. A first portion of a move-out track 20, which extends up to a further lower end point 42, then obliquely downwardly outwardly adjoins the latch position 22. Starting from this further lower end point 42, the move-out track 20 in turn continues obliquely upwardly outwardly so that it ends in each case outside the expanded portions 24. In the region of the further lower end point 42, the move-out track 20 has a step 44 which is configured such that the region of the move-out track 20 disposed after the step 44 in the direction of the arrows drawn in FIG. 2*a* is disposed lower, i.e. closer to the reflector 14, than the region of the move-out track 20 located in front of the step 44.

Figure 2B:
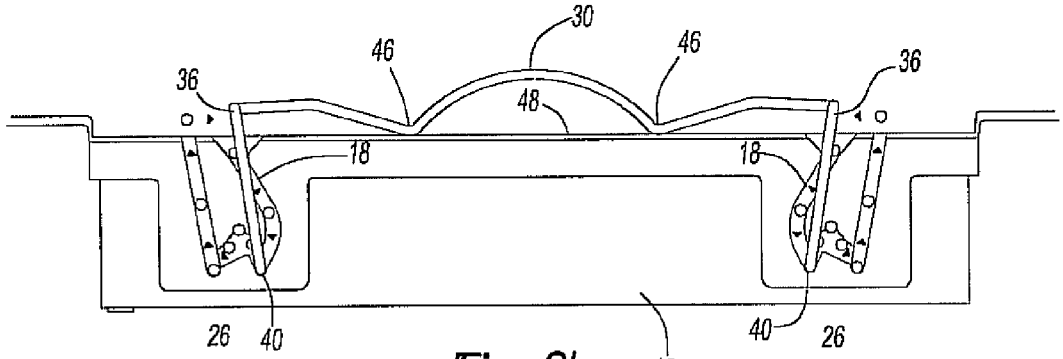

The wire spring 28 is coupled in the already explained manner to a housing frame not shown in FIGS. 1 and 2*a-d* for reasons of clarity. On the introduction of the functional frame 10 into this housing frame, the wire spring 28 is located in its relaxed position shown in FIG. 2*a* so that the two latch elements 26 are located directly above the expanded portions 24. If the functional frame 10 is now moved upwardly in the direction of the housing frame or in the direction of the wire spring 28, the latch elements 26 move into the expanded portions 24 and from there along the triangular arrows drawn in FIG. 2*a* through the first portion of the move-in track 18. In this way, the latch elements 26 are moved closer to one another due to the shape of the move-in track 18 so that the spring portion 30 arches upwardly in accordance with FIG. 2*b* and the two ends 46 of the spring portion 30 abut the upper edge 48 of the functional frame 10 and thus act on it with pressure. The last-named effect also exists when the latch elements 26 in accordance with FIG. 2*b* are located at the lower end point 40 of the move-in track 18. In this position, the two wire limbs 36 are inclined to one another and the spring portion 30 continues to arch upwardly.

To move the functional frame 10 out of its position shown in FIG. 2*a* into the position in accordance with FIG. 2*b*, it is necessary to press it upwardly against the force of the spring portion 30 in the direction of the housing. This movement is then ultimately bounded by the cooperation of the latch elements 26 with the lower end points 40 of the move-in tracks 18, whereupon the functional frame 10 can be let go of by the fitter. This then has the effect that, due to the pressure action induced by the spring portion 30 or its ends 46, the functional frame 10 is moved downwardly, with the spring portion 30 simultaneously relaxing a little so that the wire limbs 36 with the latch elements 26 arranged thereon are pivoted outwardly somewhat. The latch elements 26 thus then move into the latch position 22 in accordance with FIG. 2*c*. In this position, the downward movement of the functional frame 10 is bounded by the cooperation of the latch elements 26 and the latch positions 22. The wire limbs 36 are only slightly mutually inclined and the spring portion 30 is only slightly upwardly arched. In this position in accordance with FIG. 2*c*, however, the ends 46 of the spring portion 30 still also exert a specific pressure onto the upper edge 48 of the functional frame 10 such that the functional frame 10 is clamped and fixed in this position so-to-say between the latch elements 26 and the ends 46 of the spring portion 30.

If now the functional frame 10 is again pressed upwardly by the fitter to release the functional frame 10 from the housing (not shown) or from the wire springs 28, the latch elements 26 first abut the slope 50 of the move-out track 20, with this slop 50 then guiding the latch elements 26 to the lower end point 42 of the move-out track 20. The latch elements 26 spring over the steps 44 directly in front of this lower end point 42 so that the latch elements 26 latch behind the steps 44. This latching procedure is achieved in that the base of the move-out track 20 is elevated in front of the step 44 so that the latch elements 26 press onto the base of the move-out track 20 due to the elasticity of the wire springs 28 and thus spring behind the step 44 onto the base of the move-out track 20 disposed lower there.

Figure 2C:
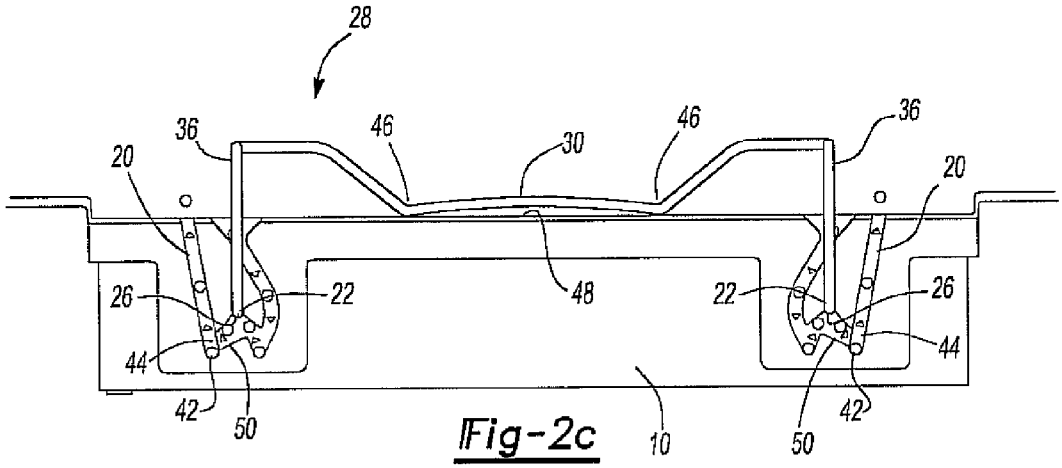
Figure 2D:
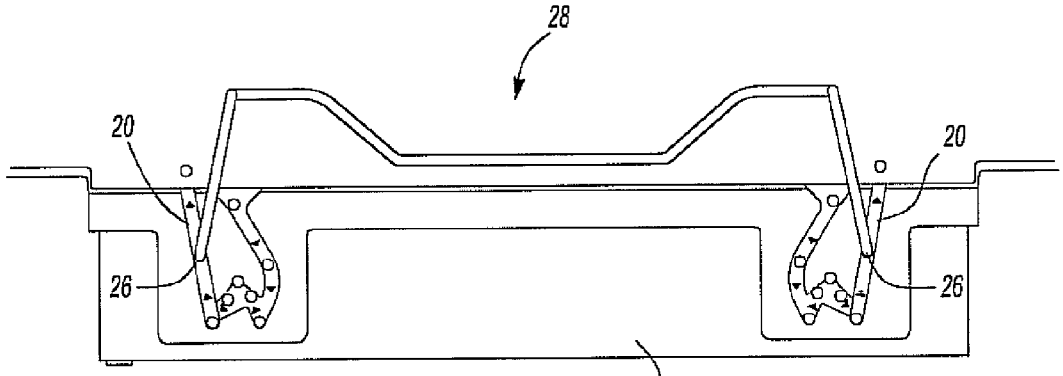

If the latch elements 26 are located at the lower end points 42 of the move-out tracks 20, the spring portion 30 is again arched somewhat more pronouncedly than shown in FIG. 2*c* so that the functional frame 10 is again pressed somewhat downwardly over the ends 46 of the spring portion 30 after ending of the pressure application by the fitter. The latch elements 26 move obliquely upwardly within the move-out tracks 20. Due to the oblique configuration of the move-out tracks 20, the functional frame 10 can, however, not fall down in an unintended manner since it continues to be held by the latch elements 26 which contact the inner sides of the move-out track 20. Only when the functional frame is actively pulled downwardly by the fitter does a spreading open of the wire springs 28 take place in which the latch elements 26 are moved further apart. This movement can be seen from FIG. 2*d*. If this movement is continued beyond the position shown in FIG. 2*d*, the latch elements 26 ultimately move completely out of the move-out tracks 20 in the arrow direction so that the functional frame 10 is completely released from the wire springs 28.

After this complete release, the wire springs 28 again spring back into their position in accordance with FIG. 2*a*.

Figure 3A:
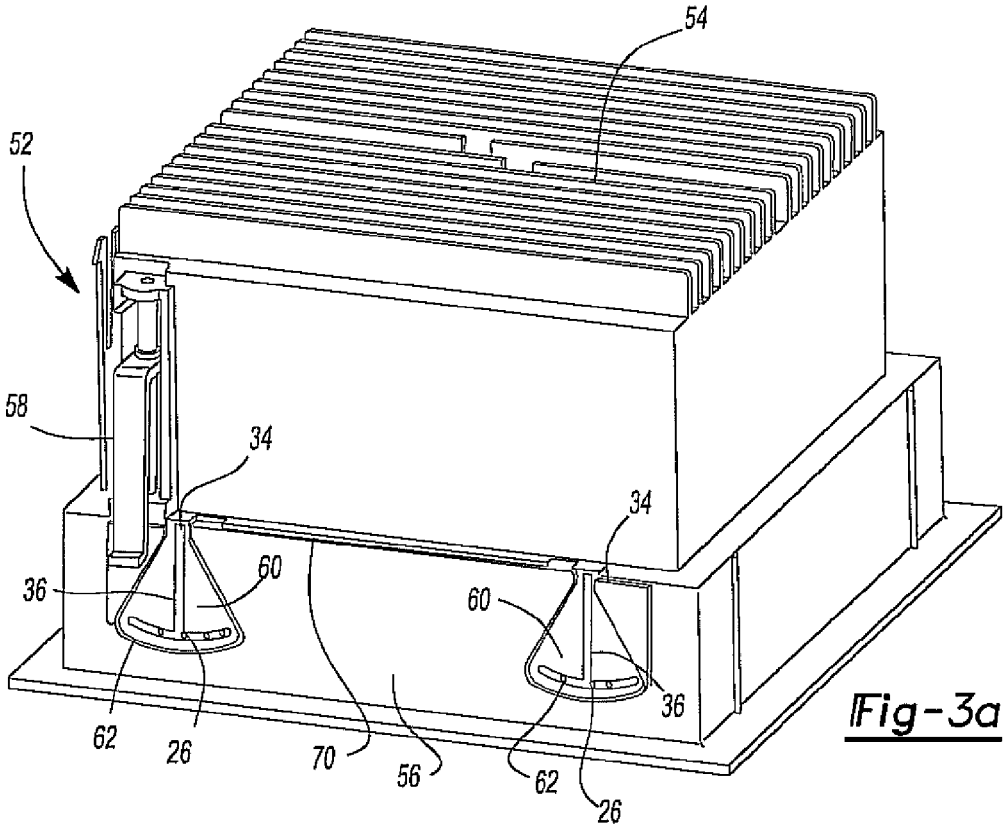

FIG. 3*a* shows, in a perspective view, a lamp housing 52 having a housing base 54 disposed against the main direction of illumination. In the main direction of illumination, the lamp housing 52 has a housing frame 56 which is made in one piece with the remaining housing part. Fastening means 58 are provided at the lamp housing 52 and the lamp housing can be fixed in a suspended ceiling, for example, by means of them.

Two cut-outs 60 which are substantially in the shape of a circle sector and in which the wire limbs 36 of the wire springs 28 are received are provided at two oppositely disposed sides of the housing frame 56 of which only one can be seen in FIG. 3*a*. In the lower region of the cut-outs 60, guide slots 62 are formed which have the shape of an arc of a circle so that the latch elements 26 connected to the wire limbs 36 can move in the guide slots 62 such as was explained in connection with FIGS. 2*a* to *d*.

Since the latch elements 26 are located within the guide slots 62, since the wire limbs 36 contact the outer side of the housing frame 56 and since the wire portions 32 connected to the wire limbs 36 via the connection regions 34 and with the spring portion 30 (not visible in FIG. 3*a*) lie on the inner side of the housing frame 56, it is ensured that the wire spring 28 is fixed in the desired position without additional fastening means at the housing frame 56. The just explained position of the wire portions 32 as well as of the spring portion 30 can be seen from FIG. 3*b* in which the lamp housing 52, including the housing frame 56, is shown in transparent form. It is, however, also possible to fasten the connection regions 34 of the wire spring 28 to the housing frame 56 in order thus to ensure a particularly good movability of the latch elements 26 within the guide slots 62. Such a fastening can, for example, be achieved with a cover metal sheet 70 (see FIGS. 3*a, b*), by means of which the connection regions 34 are clamped between the housing frame 56 and the cover metal sheet 70.

Figure 3B:
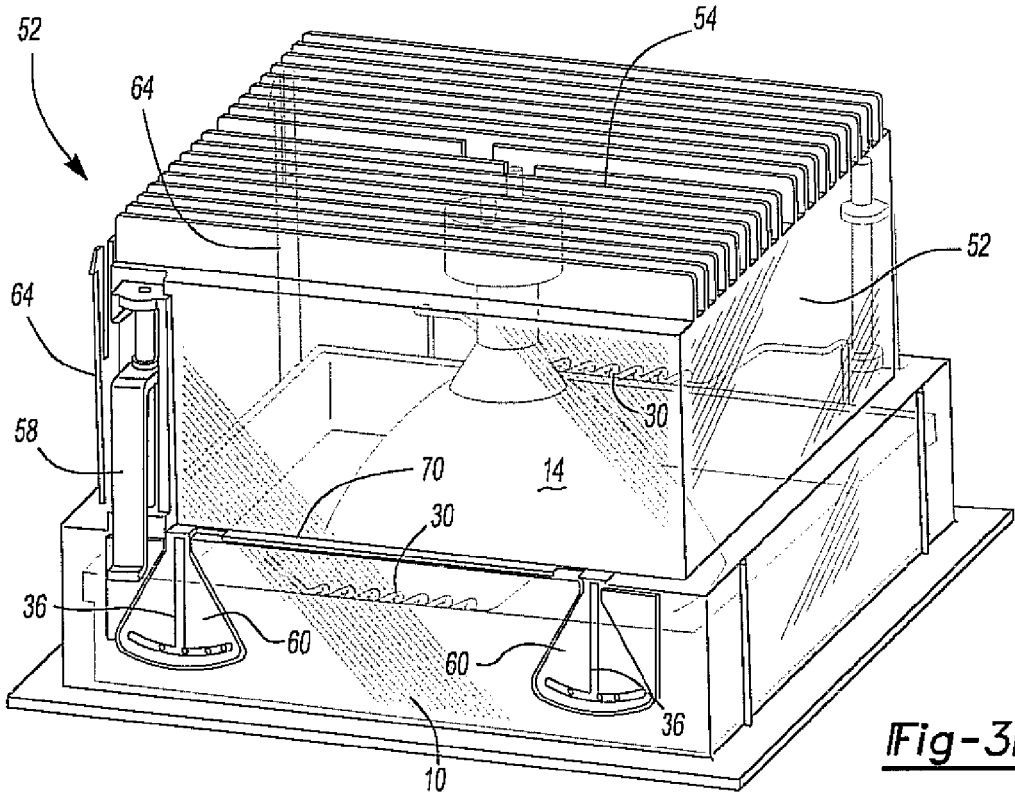

It can furthermore be seen from FIG. 3*b* that the functional frame 10 is introduced inwardly into the housing frame 56 and the spring portions 30 act on the upper edge of the functional frame 10.

Figure 4:
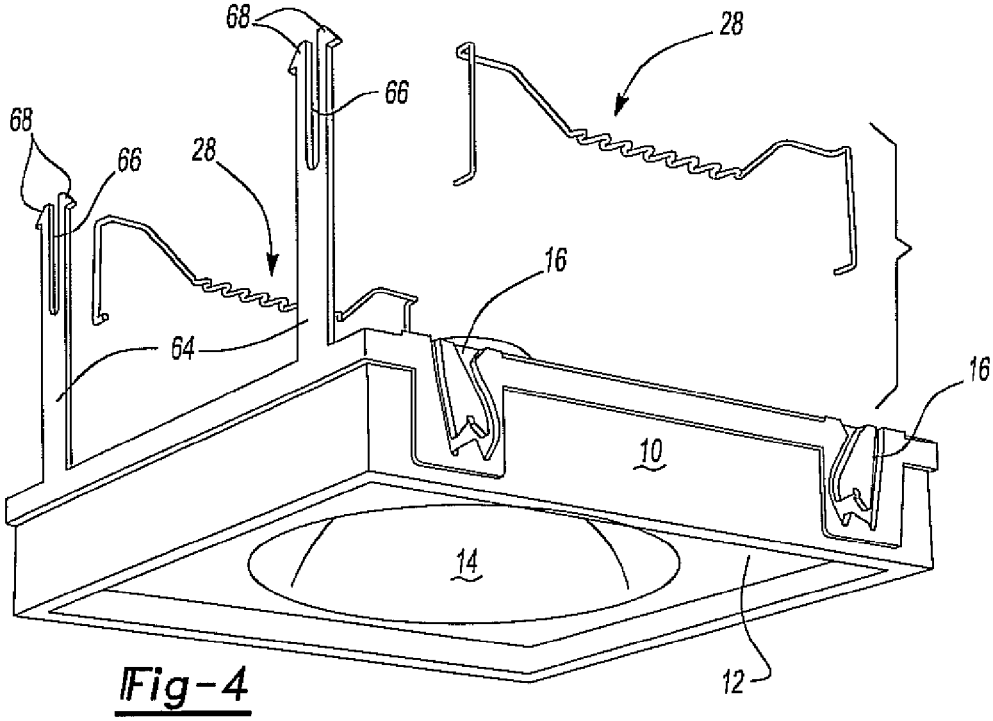
FIG. 4 is a three-dimensional view of a functional frame in accordance with FIG. 1 with two holding elements shaped thereon.

FIG. 4 shows the functional frame 10 in accordance with FIG. 1 in a perspective view from obliquely below, with, here, however, in contrast to FIG. 1, two mutually spaced apart lug-like flexible holding elements 64 being provided at a side of the functional frame 10 which has no latch receivers 16. The holding elements 64 extend perpendicular away from the said side of the functional frame 10. At their end remote from the functional frame 10, the holding elements 64 each have a longitudinal slot 66 as well as two outwardly facing hook-like elements 68 which serve for the anchorage of the holding elements 64 in the lamp housing 52 (FIG. 3*b*).

Figure 5:
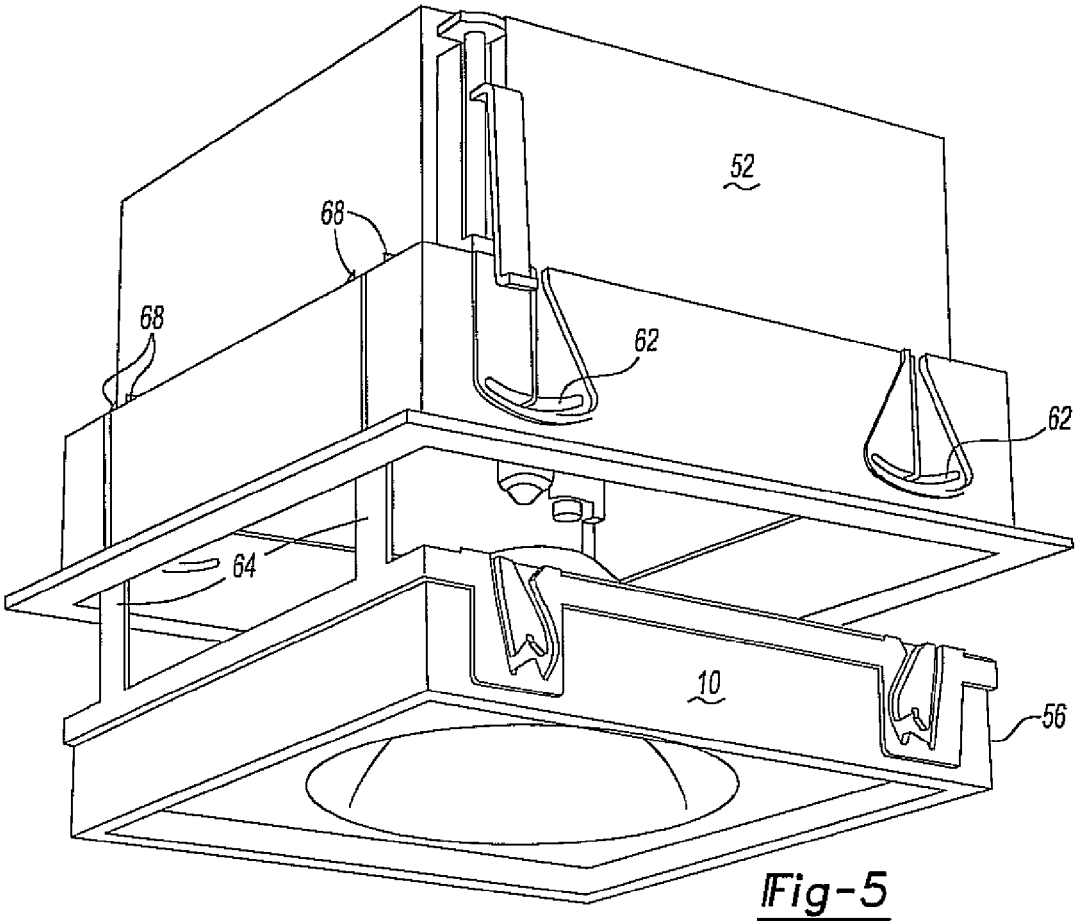
FIG. 5 illustrates a functional frame in accordance with FIG. 4 which is coupled via the holding elements to a lamp housing or to its housing frame.
Figure 6:
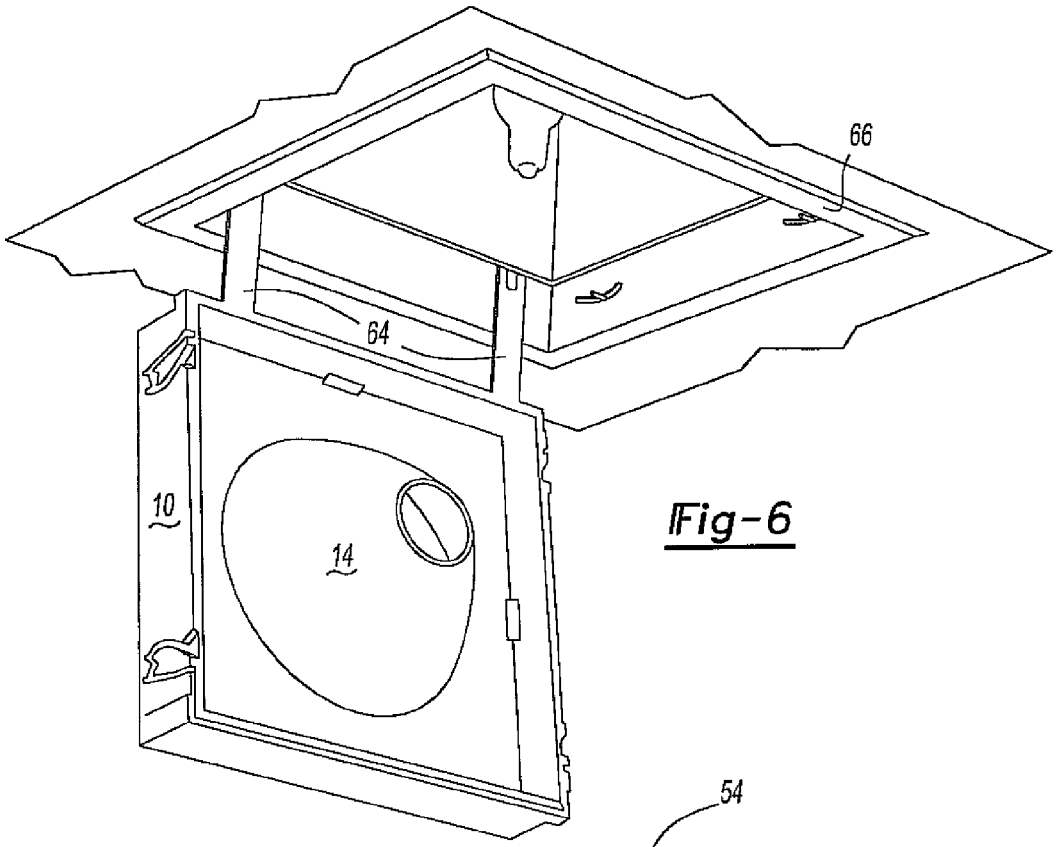
FIG. 6 illustrates a functional frame in accordance with FIG. 5 folded away from the housing frame.

When the functional frame 10 is released from the housing frame 56 and pulled out of it in the already explained manner, the holding elements 64 are simultaneously also pulled so far out of the housing frame 56 in accordance with FIG. 5 until the hook elements 68 abut the housing frame 56 in the position shown in FIG. 5 and thus prevent a further movement of the holding elements 64. In this position, the functional frame 10 can now be let go of by the fitter, whereupon it pivots away from the housing frame 56 due to the flexibility of the holding elements 64, as is shown in FIG. 6. In the position in accordance with FIG. 6, the interior of the lamp housing 52 can be accessed freely and without problem, for example for the purpose of changing a light source.

After such a changing of a light source, the functional frame 10 is simply gripped again by the fitter and is moved into the housing frame 56, with simultaneously a pushing of the holding elements 64 into the cut-outs of the housing frame 56 provided for this purpose taking place in a compulsory manner. The pressing of the functional frame 10 into the housing frame 56 is continued for so long until the latch elements 26 of the wire springs 28 latch into the latch positions 22.

Figure 7:
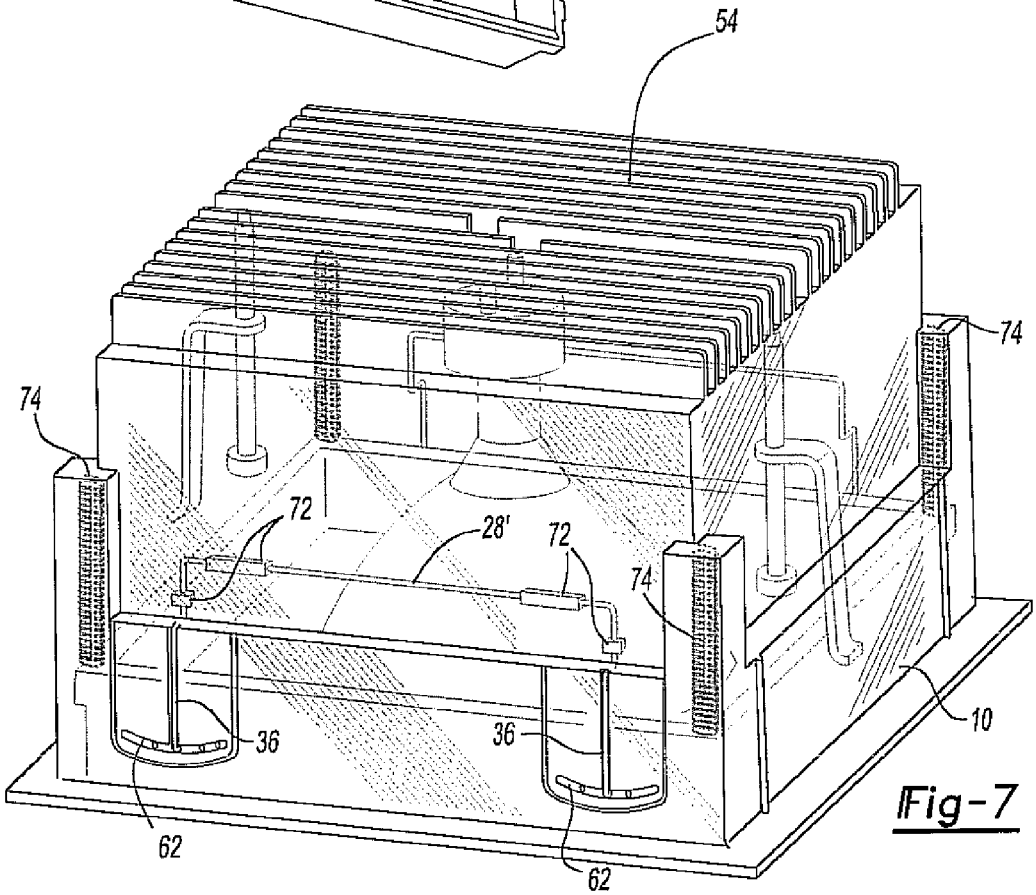
FIG. 7 is a view of an alternative embodiment of the invention in accordance with FIG. 3*b*.

FIG. 7 shows an embodiment of the invention modified with respect to FIG. 3*b*. A substantial difference consists here in the form of the wire spring 28' which, unlike FIG. 3*b*, does not have any middle spring portion 30 and also no wire portion 32 extending obliquely thereto. The spring 28' is rather bent substantially in a U shape and is fastened to the housing 54' by means of two respective fixing lugs 72 in its two corner regions. The wire limbs 36 are also pivotable in this embodiment such that the latch elements connected to them can move freely inside the guide slots 62. On such a movement of the wire limbs 36, however, the portion of the wire spring 28' connecting the two wire limbs 36 to one another does not move.

As a result of the described shape of the wire spring 28', no pre-tension is exerted on the functional frame 10 on the introduction of the same into the housing 54' as is given by the spring portion 30 in accordance with FIG. 3*b*. To nevertheless achieve such a pre-tension, respective spiral springs 74 are attached to the four corner regions of the housing 54' and these spiral springs project out of corresponding cut-outs of the housing 54' in the direction of the functional frame 10. On the introduction of the functional frame 10 into the housing 54', these spiral springs 74' are pressed together so that the effect of the pre-tensioning described in connection with FIG. 3*b* is also effected here. In a corresponding manner, the spiral springs 74 also ensure that the functional frame 10 is pressed out of the housing 54' on a release of the functional frame from the housing 54'.

The description is merely exemplary in nature and, thus, variations that do not depart from the gist of the present disclosure are intended to be within the scope of the invention. Such variations are not to be regarded as a departure from the spirit and scope of the present disclosure.

REFERENCE NUMERAL LIST

10 functional frame
12 cover plate
14 reflector
16 latch receiver
18 move-in track
20 move-out track
22 latch position
24 expanded portion
26 latch elements
28 wire springs
28' wire springs
30 spring portions
32 wire portions
34 connection regions
36 wire limbs

38 rear reflector opening
40 lower end point
42 lower end point
44 step
46 ends of the spring portion
48 upper edge of the functional frame
50 slope
52 lamp housing
54 housing base
54' housing
56 housing frame
58 fastening means
60 cut-out
62 guide slots
64 holding elements
66 longitudinal slot
68 hook elements
70 covering metal sheet
72 fixing lugs
74 spiral springs

The invention claimed is:

1. A lamp, in particular a built-in lamp for ceilings and/or walls, comprising:

a built-in housing (52) designed for the reception of a light source, a reflector (14) and associated mechanical and electrical and/or electronic components;

a housing frame (56) connected to the housing (52) and a functional frame (10) at least regionally releasable from the housing frame (56); and a closing arrangement active between the housing frame (56) and the functional frame (10), wherein the closing arrangement has at least one wire spring (28), the wire spring (28) having a spring portion (30), which extends between two latch elements (26) formed in end regions of the wire spring (28), the latch elements (26) cooperating with a respective latch receiver (16) in the functional frame (10) and wherein a respective wire limb (36) is formed between the spring portion (30) and the latch elements (26) so that the relative position of the latch elements (26) can be modified with respect to one another by a pivoting of the wire limbs (36) and a deformation of the spring portion (30) associated therewith.

2. A lamp in accordance with claim 1, wherein the housing frame (56) is received in a shape matched manner in the housing (52) or is fixedly connected to it, in particular made in one piece with the housing (52), with the wire spring (28) being arranged with its two wire limbs (36) supporting the latch elements (26) in two cut-outs (60) at the outer side of the housing frame (56).

3. A lamp in accordance with claim 1, wherein the wire limbs (36) are arranged on an outer side of the housing frame (56) and the spring portion (30) is arranged on an inner side of the housing frame, and wherein the latch elements (26) extend inwardly through guide slots (62) provided in the housing frame (56) so that the wire spring (28) is held at the housing frame (56).

4. A lamp in accordance with claim 2, wherein the wire limbs (36) are pivotable in the cut-outs (60) in dependence on the movement of the latch elements (26).

5. A lamp in accordance with claim 1, wherein the wire spring (28) engages over the housing frame (56) with two connection regions (34) disposed in each case between the spring portion (30) and the wire limbs (36) and the spring portion (30) disposed at an inner side of the frame is disposed in the introductory path of the functional frame (10) and acts on it in a resilient manner in the direction of opening.

6. A lamp in accordance with claim 1, wherein a respective spring element, in particular a respective spiral spring, is arranged in corner regions of the housing frame and of the functional frame and is connected to one of the housing frame and the functional frame, with the spring elements being disposed in an introductory path of the functional frame and acting on them resiliently in the opening direction.

7. A lamp in accordance with claim 3, wherein the latch elements (26) are formed by a respective angled end region of the wire spring (28) extending through the guide slots (62) in the housing frame (56), and wherein the respective associated latch receiver (16) in the functional frame (10) has a move-in track (18) and a move-out track (20) and a latch position (22) provided therebetween, with latching and unlatching of the latch elements (26) taking place by exerting pressure onto the functional frame (10) in its closing direction.

8. A lamp in accordance with claim 1, wherein two wire springs (28) are provided at mutually oppositely disposed sides of the housing frame (56), which is in particular rectangular or square.

9. A lamp in accordance with claim 1, wherein a peripheral seal, in particular a labyrinth seal, is formed in an introduced and latched position of the functional frame (10) between it and the housing frame (56).

10. A lamp in accordance with claim 1, wherein the functional frame (10) is made as a bearer of one of the reflector (14) and a part reflector.

11. A lamp in accordance with claim 1, wherein the functional frame (10) bears at least one of a light permeable cover plate and scattering plate (12).

12. A lamp in accordance with claim 1, wherein the functional frame (10) is coupled to at least one flexible holding element (64), which continues to connect the functional frame (10) to the lamp housing (52) in its position released from the lamp housing (52).

13. A lamp in accordance with claim 12, wherein two holding elements (64) are attached to a side of the functional frame (10).

14. A lamp in accordance with claim 12, wherein the holding elements (64) are shaped in one piece with the functional frame (10), with the functional frame (10) in particular being made as a plastic injection molded part.

15. A lamp in accordance with claim 12, wherein the holding elements (64) can be pushed with their region remote from the functional frame (10) into a housing opening.

* * * * *